US005125020A

United States Patent [19]

Penato et al.

[11] Patent Number: 5,125,020

[45] Date of Patent: Jun. 23, 1992

[54] ANODE FOR X-RAY TUBE WITH HIGH MECHANICAL STRENGTH

[75] Inventors: Jean-Marie Penato, Les Essarts-le-Roi; Michel Laurent, Plaisir; Philippe Thomas, Villeneuve sous Dammartin, all of France

[73] Assignee: General Electric CGR S.A., Issy les Moulineaux, France

[21] Appl. No.: 619,925

[22] Filed: Nov. 27, 1990

[30] Foreign Application Priority Data

Nov. 28, 1989 [FR] France ..... 89 15632

[51] Int. Cl.[5] ..... H01J 35/10

[52] U.S. Cl. ..... 378/143; 378/125; 378/127; 378/144

[58] Field of Search ..... 378/119, 121, 125, 127, 378/143, 144

[56] References Cited

U.S. PATENT DOCUMENTS 3,763,387 10/1973 Silbermann .
3,790,838 2/1974 Baum .
3,969,131 7/1976 Fatzer et al. ..... 378/144
4,073,426 2/1978 Devine, Jr. .
4,276,493 6/1981 Srinivasa et al. .
4,531,227 7/1985 Fukuhara et al. ..... 378/125

FOREIGN PATENT DOCUMENTS 2225839 11/1974 France .
51-147987 5/1977 Japan .
60-95841 5/1985 Japan .
63-146331 6/1988 Japan .

*Primary Examiner*—Janice A. Howell
*Assistant Examiner*—David P. Porta
*Attorney, Agent, or Firm*—Cushman, Darby & Cushman

[57] ABSTRACT

The apparatus is an anode for an X-ray tube which is rotated at high speeds during operation. The anode include a plate of refractory material with high mechanical strength. On both faces of the plate are fixed two blocks of light weight refractory material. One of the blocks is formed of several sub-blocks fixed to one another through brazing. A layer of X-ray emitting mattering is deposited on the outer surface of these sub-blocks.

10 Claims, 1 Drawing Sheet

FIG. 1
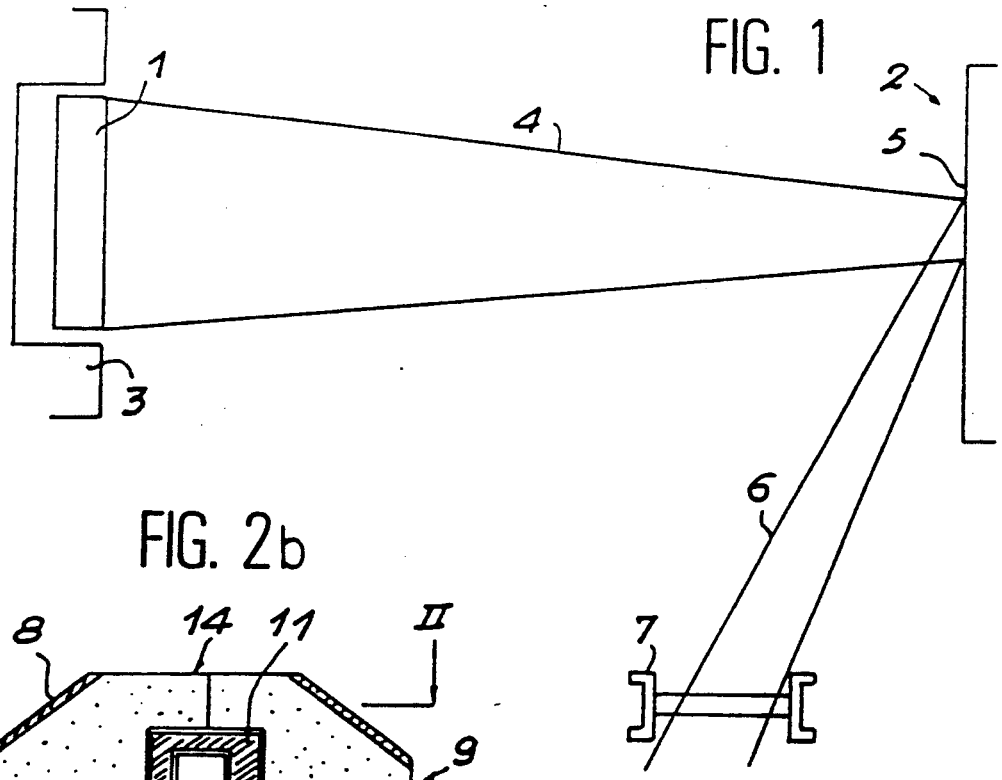
FIG. 2b
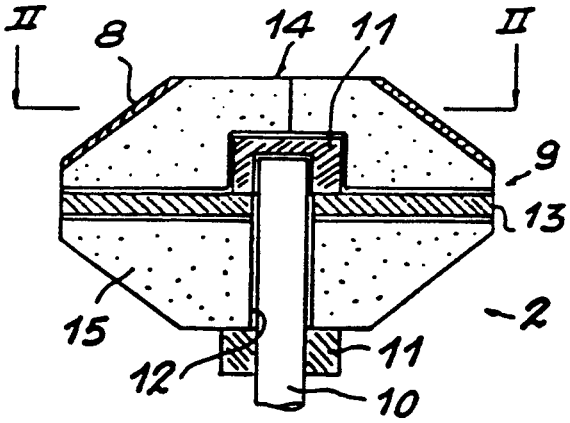
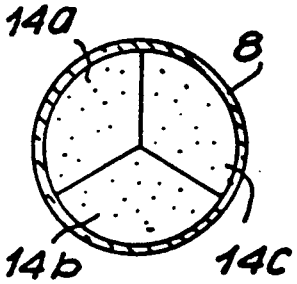
FIG. 2a
FIG. 3
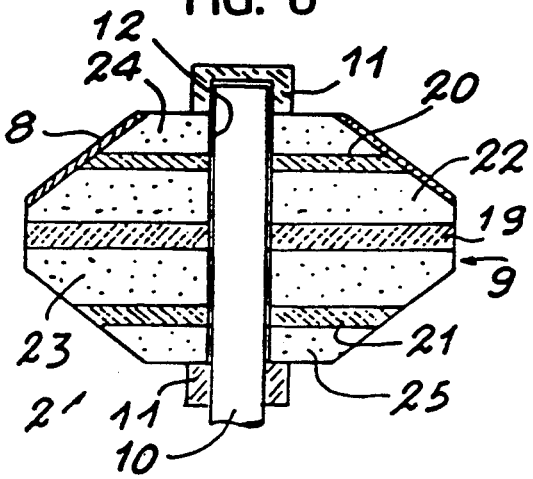
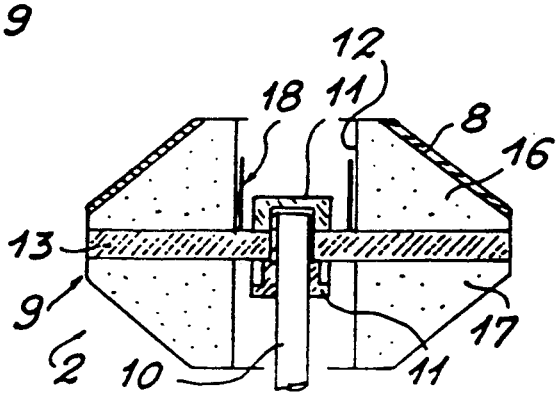
FIG. 4

ANODE FOR X-RAY TUBE WITH HIGH MECHANICAL STRENGTH

BACKGROUND OF THE INVENTION

1. Field of the Invention

The invention concerns an X-ray tube anode, more particularly a rotating anode of the type having a main body made of a light material bearing a target formed by a surface layer of an X-ray emitting material.

2. Description of the Prior Art

In X-ray tubes, notably those used for X-ray diagnosis, the X-radiation is obtained under the effect of an electron bombardment of a layer of a target material, i.e. generally a material, with a high atomic number, that is refractory and is a good conductor of heat such as, for example, tungsten, molybdenum or an alloy containing at least one of these elements. These are the elements most commonly used, but the invention is not restricted to an anode with an emissive material containing these elements or their alloys.

The target layer is bombarded on a small surface, called a focal spot, forming the source of the radiation.

For a long time now, the high instantaneous power values (of the order of 100 KW) used and the small dimensions of the focal spot have led to the use of rotating anodes in order to distribute the heat flux on a greater area than that of the focal spot and to dissipate it more efficiently. This distribution and dissipation of heat is all the more efficient as the linear speed of rotation of the anode is high.

However, this linear speed is limited by the mechanical strength of the anode. Thus, anodes having a metallic base have been proposed to obtain an anode with high mechanical strength. However, this base is heavy, and this is inconvenient when the anode has to rotate at high speed. Thus, with this type of anode, the rotation speed is restricted by this heaviness of the anode. Moreover, at high temperature, there is a risk that the metal will get deformed by warping in a direction perpendicular to its main plane.

To overcome this drawback, it has been proposed to make bodies out of light material such as graphite or carbon-carbon composite material. However, these materials are either excessively brittle or, in the case of carbon-carbon composite material, their homogeneity is insufficient to allow them to be used with high rotation speeds.

Anodes have also been proposed with graphite brazed to the metal part forming the emitting part, but they are heavy.

It is an aim of the invention, notably, to overcome these drawbacks by proposing an anode that has a main body with a particular structure that reinforces the mechanical strength of the anode and is relatively light, enabling use with high rotation speeds.

SUMMARY OF THE INVENTION

To this effect, the invention proposes an anode for an X-ray tube, comprising a body or substrate, on at least one part of the surface of which there is deposited a target layer of X-ray emitting material, wherein the body has at least one plate or disk of refractory material with high mechanical strength, on which there are fixed at least two blocks made of light weight refractory material on which the target layer of emissive material is deposited.

Thus, the plate made of a material with high mechanical strength forms a mechanically strong web in the radial direction, and the association with the blocks made of light weight material, which notably define the area on which a target layer of emissive material is deposited, gives a relatively light-weight anode with high calorific capacity and high resistance to deformation perpendicularly to the plane of the anode.

The metal web is preferably made of a thin plate that is rolled or forged so as to obtain a crystalline texture oriented in parallel to the plane, giving it high mechanical strength against forces acting parallel to the plane.

In a second embodiment of the invention, the body comprises several superimposed plates of refractory material with high mechanical strength, the blocks of light material being interposed between said layers, and a block made of light weight material being fixed to the external face of the external layers made of material with high mechanical strength. This structure of the body, in the form of multiple layers, also reinforces the mechanical strength of the anode.

To prevent the spread of cracks, at least one of the blocks made of light weight material is formed by several elements assembled together along planes that are parallel or secant with the longitudinal plane of the anode.

Advantageously, this assembling plane is perpendicular to the longitudinal plane. According to another feature of the invention, the anode has a central bore hole that opens out, or a blind bore hole, to enable it to be mounted on a supporting and rotationally driven shaft. According to a preferred aspect of the invention, means for fixing the anode to the shaft cooperates with one of the plates made of refractory material with high mechanical strength. Thus, there is no risk that the pressure exerted by this fixing means, which is a nut for example, will cause the fracture of the light weight material; for example through the creation of stresses in this material which will be amplified by the high speed of rotation.

As refractory materials with high mechanical strength it is proposed to use, for example, molybdenum, tungsten, and their alloys, (a refractory metal alloy) for example, an alloy of tungsten, rhenium, molybdenum, titanium-zirconium or alloys with tantalum. This list is given purely by way of indication and is in no way restrictive.

As light weight materials it is proposed to use, for example, graphite, carbon-carbon composites, ceramic materials, etc.

Another object of the invention is an X-ray tube including a rotating anode such as is described here above.

BRIEF DESCRIPTION OF THE DRAWINGS

Other aims, advantages and features of the invention will appear more clearly in the light of the following exemplary embodiments of the invention. The description of these embodiments, are given purely as an indication and made with reference to the appended drawings, wherein:

FIG. 1 is a schematic and simplified representation of an X-ray tube;

FIGS. 2*a* and 2*b* are schematic views, in cross-section, of a first embodiment of an anode according to the invention;

FIG. 3 is a schematic view, in cross-section, of a second embodiment of an anode according to the invention; and FIG. 4 is a schematic view, in cross-section, of a third embodiment of an anode according to the invention.

DESCRIPTION OF PREFERRED EMBODIMENTS

Referring to FIG. 1, an X-ray tube comprises, in an empty chamber (not shown), a cathode 1 located so as to face an anode 2. The cathode 1 is inserted in an optical focusing set 3 enabling the electron beam 4 emitted by the cathode to be guided towards and focused on a small surface 5 of the anode 2 called a focal spot.

The emission of the electron beam 4 by the cathode is generated by the heating of a filament (not shown) to high temperature. The anode 2 receives the electron beam 3, and emits an X-radiation beam referenced 6, notably towards a window 7 provided, for example, on the envelope of the tube.

The anode 2 is mounted on a rotationally driven shaft (not shown). Thus, the focal spot 5 is a ring of small width defined on the surface of the anode 2. Referring to FIGS. 2 to 4, three embodiments of the invention will be now described. The same references numbers are repeated for the identical parts in each of these figures. The shape of the anodes represented has been given purely as an illustration and does not restrict the scope of the invention.

In the three embodiments shown, the anode 2 has a layer 8 made of X-radiation emitting material deposited on a part of the external surface of a body or substrate 9. This target layer 8 may be deposited directly on the body 9 or, preferably, on one or more intermediate layers (not shown) to improve notably the anchoring of the target layer. A feature such as this has already been described and is commonly used to make an anode for an X-ray tube.

The anodes shown are also of the rotating type mounted on a supporting axis 10, for example by a system of bolts and nuts 11, the shaft being advantageously housed in a central bore 12 that goes right through (FIGS. 3, 4) or is blind (FIG. 2).

According to the invention, and in a first embodiment, the body 9 has a central disk 13 or plate made of a material with high mechanical strength such as molybdenum, with a thickness of about 0.3 millimeter. To the faces of this disk there are fixed, for example, by brazing, two graphite blocks 14, 15, machined to the desired shape before or after they are fixed.

In the embodiment shown in FIGS. 2*b*, 2*a*, the block 14, made of graphite, advantageously consists of three parts 14*a*, 14*b*, 14*c*. These parts are parts of disks and are assembled together by brazing. Through the presence of these interfaces or breaks in the material, it is possible to restrict the possible spreading of cracks in the material or to decrease the tendency for it to break up.

In the embodiment shown in FIG. 2*b*, the shaft 10 is screwed into the nut 11, directly fixed to the central disk 13. Advantageously, the block 14 includes a blind bore hole 12 to house the nut 11.

By contrast, in the embodiment illustrated in FIG. 4, the graphite blocks 16, 17 have a central bore 12 with a diameter that is slightly greater than the diameter of the nut 11. To reinforce the fixing of the blocks 16, 17 and the mechanical strength of the assembly, supporting walls 18 are fixed to the disk 13 to form a supporting surface for the blocks 16, 17.

In the embodiment shown in FIG. 3, the body 9 has several disks 19, 20, 21 made of a material with high mechanical strength such as an alloy of molybdenum, titanium or zirconium, with a thickness of about 0.3 millimeter. Between these disks there are interposed disks 22, 23, 24, 25, made of graphite or of a carbon/carbon composite material or again a ceramic material.

The fixing among these different layers is done by brazing. The shaft 10 is fixed by two nuts 11 taking support on the external blocks of graphite. The appropriate brazing compounds are those with a high melting point such as zironium-based or platinum-based brazing compounds.

The anodes of the invention have high mechanical strength and, by the presence of the graphite blocks, they are very light and have high calorific capacity. The nature of the target layers, their mode of deposition or fixing and the number of the disks or plates of material with high mechanical strength may be different without going beyond the scope of the invention.

What is claimed is:

1. A rotationally driven anode for an X-ray tube comprising:
   - a body of refractory material with high mechanical strength capable of withstanding stresses created at high rotational speeds of said anode, said body having a first and second face;
   - at least a first and second block of light weight refractory material which does not adversely affect said high rotational speeds of said anode, said first and second blocks being fixed to said first and second face, respectively;
   - at least a first and second sub-block fixed to each other forming one of said first and second blocks; and
   - a layer of X-ray emitting material deposited on said first and second sub-blocks.

2. An anode according to claim 1 wherein said body comprises:
   - alternating layers of refractory material with high mechanical strength and light weight refractory material fixed together, and said first and second face being refractory material with high mechanical strength.

3. An anode according to claim 1, wherein said light weight material is chosen from the group including graphite, graphite-graphite composites, carbon-carbon composites, ceramics, fiber composites and ceramic matrix composites.

4. An anode according to claim 1, wherein the refractory material with high mechanical strength is chosen from the group including molybdenum, molybdenum-titanium-zirconium alloys and alloys of molybdenum, tungsten and rhenium.

5. An anode according to claim 1, further comprising:
   - a shaft passage in said body, and said first and second block; and
   - a fixing means supported by said body for fixing a shaft which supports and rotationally drives said anode.

6. An anode according to claim 5 wherein said fixing means is a nut fixed to one of said first and second face.

7. An anode according to claim 5, wherein said fixing means supports one of said first and second blocks.

8. An anode according to claim 1, wherein said body is a plate.

9. An anode according to claim 8, wherein said plate is a disk.

10. A rotationally driven anode for an X-ray tube comprising:

a plate of refractory material with high mechanical strength capable of withstanding high rotational speeds, said plate having a first and second face;

a first and second block of light weight refractory material, which does not adversely affect said high rotational speeds, fixed to said first and second face, respectively;

a plurality of wedge shaped sub-blocks fixed together to form one of said first and second blocks; and a layer of X-ray emitting material deposited on outer surfaces of said wedge shaped sub-blocks.

* * * * *